US009822774B2

(12) United States Patent
Schneeberger et al.

(10) Patent No.: US 9,822,774 B2
(45) Date of Patent: Nov. 21, 2017

(54) DIAPHRAGM PUMP HAVING A STRIP CONNECTOR

(75) Inventors: Niklaus Schneeberger, Kōnis (CH); Eric Chappel, Versonnex (FR)

(73) Assignee: DEBIOTECH S.A., Lausanne (CH)

( * ) Notice: Subject to any disclaimer, the term of this patent is extended or adjusted under 35 U.S.C. 154(b) by 235 days.

(21) Appl. No.: 13/512,463

(22) PCT Filed: Nov. 19, 2010

(86) PCT No.: PCT/IB2010/055310

§ 371 (c)(1),
(2), (4) Date: May 29, 2012

(87) PCT Pub. No.: WO2011/070468

PCT Pub. Date: Jun. 16, 2011

(65) Prior Publication Data

US 2012/0237375 A1 Sep. 20, 2012

(30) Foreign Application Priority Data

Dec. 7, 2009 (EP) ..... 09178168

(51) Int. Cl.
*F04B 43/04* (2006.01)
*F04B 19/00* (2006.01)

(52) U.S. Cl.
CPC ..... *F04B 43/046* (2013.01); *F04B 19/006* (2013.01); *F04B 43/043* (2013.01)

(58) Field of Classification Search
CPC ..... F04B 43/04; F04B 43/046; F04B 43/043; F04B 19/006
USPC ..... 417/412, 413.1, 413.2, 413.3; 92/104; 310/311
See application file for complete search history.

(56) References Cited

U.S. PATENT DOCUMENTS 2,228,565 A * 1/1941 Haddaway ..... F04B 43/025 417/412
2,488,995 A * 11/1949 Thiberg ..... F04B 43/04 417/413.1
2,829,601 A * 4/1958 Weinfurt et al. ..... 417/413.1
(Continued)

FOREIGN PATENT DOCUMENTS

GB 311629 * 5/1929 ..... B60K 25/00
JP 1-266376 10/1989
(Continued)

OTHER PUBLICATIONS

International Search Report for PCT/IB2010/055310, dated Feb. 21, 2011.

(Continued)

*Primary Examiner* — Essama Omgba
*Assistant Examiner* — Timothy Solak
(74) *Attorney, Agent, or Firm* — Nixon & Vanderhye P.C.

(57) ABSTRACT

A micropump in the form of a stack comprising, in succession, a flexible diaphragm, a pumping chamber and a closing-off plate, said pumping chamber communicating with the outside, for example via the flexible diaphragm; said diaphragm being furthermore secured to an actuator arranged outside the micropump, characterized in that said diaphragm is secured to the actuator by way of at least one element in the form of a strip, which is rigid along its main axis and flexible in the direction perpendicular to its main axis.

24 Claims, 3 Drawing Sheets

(56) References Cited

U.S. PATENT DOCUMENTS

| | | | | |
|---|---|---|---|---|
| 3,833,876 | A * | 9/1974 | Bassett | 337/370 |
| 4,162,876 | A * | 7/1979 | Kolfertz | 417/413.1 |
| 5,759,014 | A | 6/1998 | Van Lintel et al. | |
| 5,759,015 | A | 6/1998 | Van Lintel et al. | |
| 6,139,156 | A * | 10/2000 | Okamori | G02B 27/0927 348/E9.027 |
| 6,309,189 | B1 | 10/2001 | Rey-Mermet et al. | |
| 6,425,740 | B1 * | 7/2002 | Jacobsen | F04B 7/0076 417/2 |
| 6,428,289 | B1 * | 8/2002 | Lishanski | F04B 17/003 417/413.2 |
| 2001/0014286 | A1 * | 8/2001 | Peters et al. | 417/53 |
| 2004/0005384 | A1 * | 1/2004 | Cai | A47J 31/0647 426/77 |
| 2005/0074134 | A1 * | 4/2005 | Pearce | H04R 17/00 381/190 |
| 2005/0221147 | A1 * | 10/2005 | Shioya | F16K 31/004 429/443 |
| 2006/0146096 | A1 * | 7/2006 | Wright | F04B 9/105 347/68 |
| 2008/0100179 | A1 * | 5/2008 | Ruggeri et al. | 310/332 |
| 2008/0148836 | A1 * | 6/2008 | Rey | G01L 1/18 73/146 |
| 2009/0197061 | A1 * | 8/2009 | Lucat | B81C 99/0095 428/209 |

FOREIGN PATENT DOCUMENTS

| | | |
|---|---|---|
| JP | 2004-116327 | 4/2004 |
| WO | WO 2006/056967 A1 | 6/2006 |

OTHER PUBLICATIONS

French-language Written Opinion of the International Searching Authority for PCT/IB2010/055310, dated Feb. 21, 2011.

Chinese Office Action dated Mar. 27, 2014 issued in Chinese Patent Application No. 201080048311.5 and English Translation, 16 pp.

English Translation of International Preliminary Report on Patentability (IPRP) for PCT/IB2010/055310, dated Jul. 4, 2012.

William L Benard, et al., "Thin-Film Shape-Memory Alloy Actuated Micropumps", Journal of Microelectromechanical Systems, vol. 7, No. 2, (Jun. 1, 1998).

Zengerle R, et al., "The VAMP—A new device for handling liquids or gases", Sensors and Actuators A, vol. 57, No. 2, (Nov. 1, 1996), pp. 153-157.

Schubert S, et al., "Hybrid-assembled micro dosing system using silicon-based micropump/valve and mass flow sensor", Sensors and Actuators A, vol. 69, No. 10, (Jun. 30, 1998), pp. 85-91.

Abhari, Farideh, et al., "A Comprehensive Study of Micropumps Technologies," International Journal of Electrochemical Science, vol. 7, 2012, pp. 9765-9780.

Dumont-Fillon, Dimitry, et al., "Insulin Micropump with Embedded Pressure Sensors for Failure Detection and Delivery of Accurate Monitoring," Micromachines, vol. 5, 2014, pp. 1161-1172.

Laser, D. J., et al., "A review of micropumps," Journal of Micromechanics and Microengineering, vol. 14, 2004, pp. R35-R64.

Maillefer, Didier, et al., "A High-Performance Silicon Micropump for Disposable Drug Delivery Systems," IEEE, 2001, pp. 413-417.

Nisar, A., et al., "MEMS-based micropumps in drug delivery and biomedical applications," Sensors and Actuators B, vol. 130, 2008, pp. 917-942.

Schneeberger, Niklaus, et al., "Disposable Insulin Pump—A Medical Case Study," DTIP of MEMS & MOEMS, 2004, pp. 25-27.

Smits, Jan G., et al., "The constituent equations of piezoelectric bimorphs," Sensors and Actuators A, vol. 28, 1991, pp. 41-61.

Young, Warren C., et al., "Roark's Formulas for Stress and Strain," Seventh Edition, ISBN 0-07-072542-X, 1989, 854 pages.

* cited by examiner

DIAPHRAGM PUMP HAVING A STRIP CONNECTOR

This application is the U.S. national phase of International Application No. PCT/IB2010/055310, filed 19 Nov. 2010, which designated the U.S. and claims priority to EP Application No. 09178168.2, filed 7 Dec. 2009, the entire contents of each of which are hereby incorporated by reference.

FIELD OF THE INVENTION

The invention concerns micropumps obtained by micromachining and adapted to be activated by means of an actuator such as a piezo-electric element.

PRIOR ART

Such devices are notably described in international patent application WO 2006/056967.

These devices generally take the form of a stack, i.e. a support plate, an intermediate layer serving as flexible membrane, a pumping chamber and a closure plate, the pumping chamber communicating with the exterior, for example via the support plate. Part of the membrane is fastened to a piezo-electric element disposed externally of the device. The connection between these two elements is provided by means of at least one element, for example a block produced in the support plate by micromachining.

SUMMARY OF THE INVENTION

The problem that the present invention proposes to solve lies in the difficulty of providing an effective connection between a membrane and an actuator that is deformed when it is activated.

In the case of the invention, the solution to the aforementioned problem consists in a micropump taking the form of a stack successively comprising a support plate, an intermediate layer serving as flexible membrane, a pumping chamber and a closure plate, said pumping chamber communicating with the exterior of the micropump, for example via the support plate, said membrane being fastened to an actuator disposed externally of the micropump, the connection being effected via a passage through the support plate.

The actuator may be chosen from piezo-electric bimorph actuators, piezo-electric multimorph actuators, thermal bimorph actuators and shape memory alloy beams.

Despite its small overall size, this type of actuator can exert high forces, typically of the order of 0.1 N to 100 N.

Moreover, this type of actuator may exert a movement of small amplitude along a non-rectilinear trajectory, for example a circular arc. The length of the trajectory may be less than 1 mm.

The invention is characterized in that said membrane is fastened to the actuator via at least one element taking the form of a strip, rigid along its main axis and flexible in the direction perpendicular to its main axis. The stiffness enables transmission of the force of the actuator into a linear movement of the membrane while the flexibility provides the lateral transmission of that force.

The actuator is preferably a piezo-electric bimorph actuator plate.

The actuator advantageously has a fixed end and a free end, the latter being disposed cantilever-fashion at the exit from the passage. One of the ends of the strip is fixed to said free end.

The strip is preferably stuck to the piezo-electric element.

In a variant of the invention, the strip is in direct contact with the membrane. In this configuration, the strip is preferably stuck to the membrane.

In order to reinforce the sticking, the end of the strip that is fixed to the membrane preferably includes holes or has a crenelated contour.

The strip may be constituted of any material enabling the target objective to be achieved. It is advantageously in stainless steel.

According to one embodiment of the invention, the piezo-electric element includes electrical contacts disposed in the vicinity of said fixed end.

A particularly beneficial configuration consists in fixing the micropump to a rigid part, to which part said fixed end of the piezo-electric element is also fixed. The elements constituting this assembly thus form a closed loop.

During the assembly of these elements, variations of geometry or defects of alignment may nevertheless occur, and do so cumulatively, leading to unacceptable errors or hyperstatism when the last fixing is effected.

In this case the sticking of the membrane of the micropump and the flexible element is preferably effected last. In this way these two elements are fixed in their relative position by the other elements and fixings of the loop.

Fixing (for example gluing) them last thus enables variations of geometry to be absorbed and prevents hyperstatism by fixing this relative position.

DETAILED DESCRIPTION OF THE INVENTION

The invention is described in more detail hereinafter by means of examples illustrated by the following figures.

Figure 1:
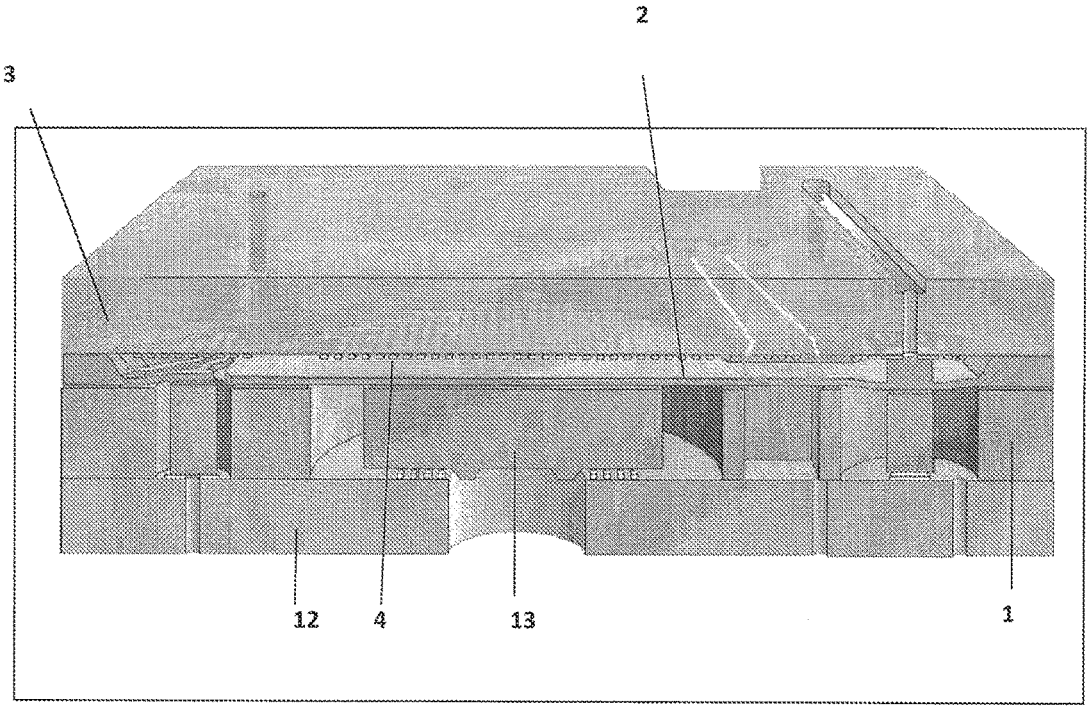
Fig.1 Prior Art
FIG. 1 shows a type of micropump that may be used in the context of the present invention.

The following numerical references are used in the present application:

1. Support plate
2. Flexible membrane
3. Closure plate
4. Pumping chamber
5. Piezo-electric element
6. Strip
7. Passage
8. Fixed end of the piezo-electric element
9. Free end of the piezo-electric element
10. Upper end of the strip
11. Rigid part
12. Base plate
13. Transmission block
14. Lower end of the strip
15. Electrical contact The micropump shown in FIG. 1 is formed of elements preferably in silicon and in glass. It is produced by means of micromachining technologies known in themselves. It notably comprises a base plate 12 in glass, a support plate 1 in silicon, a flexible membrane 2 in silicon, a pumping chamber 4 and a closure plate 3 in glass, the pumping chamber 4 being defined between the membrane 2 and the closure plate 3. A more detailed description of the structure and operation of such a pump is given in U.S. Pat. No. 5,759,014.

A piezo-electric element 5 (not shown in FIG. 1) is fastened to a transmission block 13 machined in the support plate 3.

Figure 2:
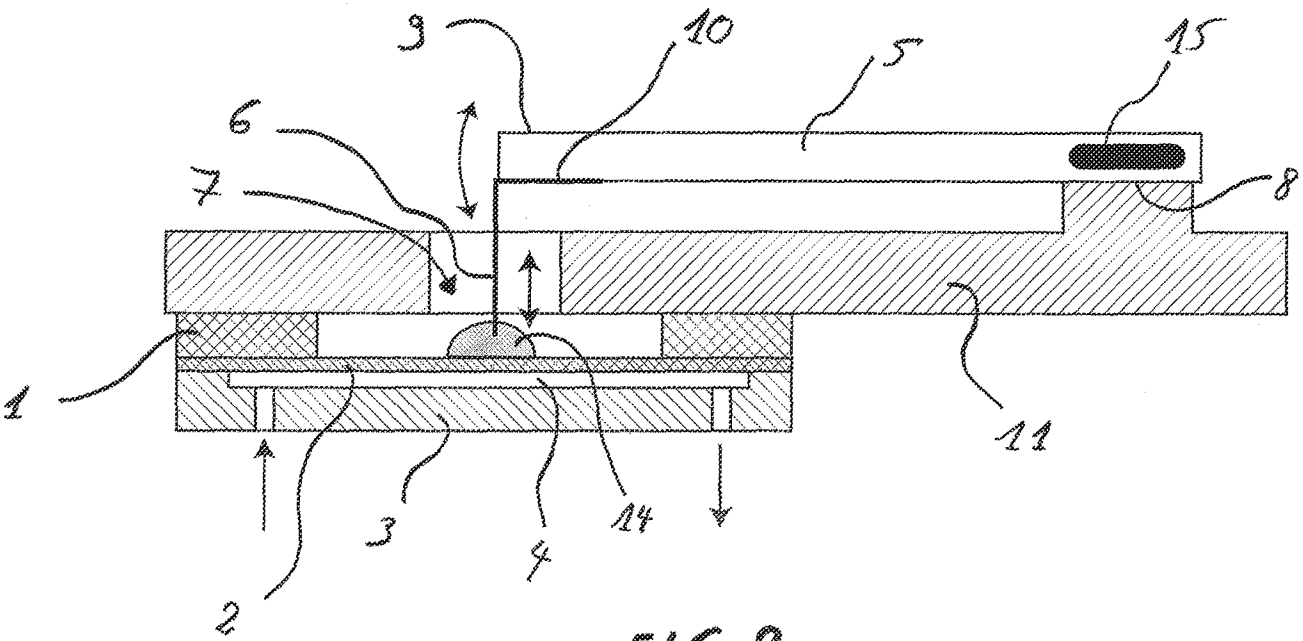
FIG. 2 represents a variant embodiment of the invention.

FIG. 2 is a diagrammatic sectional view of a variant of the invention.

The electrical voltage applied to the fixed end 8 of a piezo-electric element 5 induces its contraction, which contraction is reflected in a circular movement of its free end 9. The maximum displacement of the piezo-electric element 5 thus occurs at its free end 9. A plurality of electrical contacts 15 are placed in such a manner that by applying a voltage to each of them movement occurs in either one direction or the other and/or increases the movement.

The free end 9 of the piezo-electric element is attached to an upper end 10 of a strip 6 disposed in a vertical direction, inside a passage 7 of cylindrical shape. The strip 6, constituted of stainless steel, for example, thus has a horizontal (lateral) flexibility. It may thus move in this direction when a horizontal force acts on it, which in the present instance is produced by means of the piezo-electric element 5.

It should be noted at this point that prior art systems absorb the horizontal load at pivot points, by integrating parts with rotary movements.

The invention consists mainly in using as the connecting element 6 a strip that is easily deformable horizontally. Moreover, the strip 6 is sufficiently rigid and strong along its main axis to transmit movement of the piezo-electric element to the membrane 2.

Figure 3:
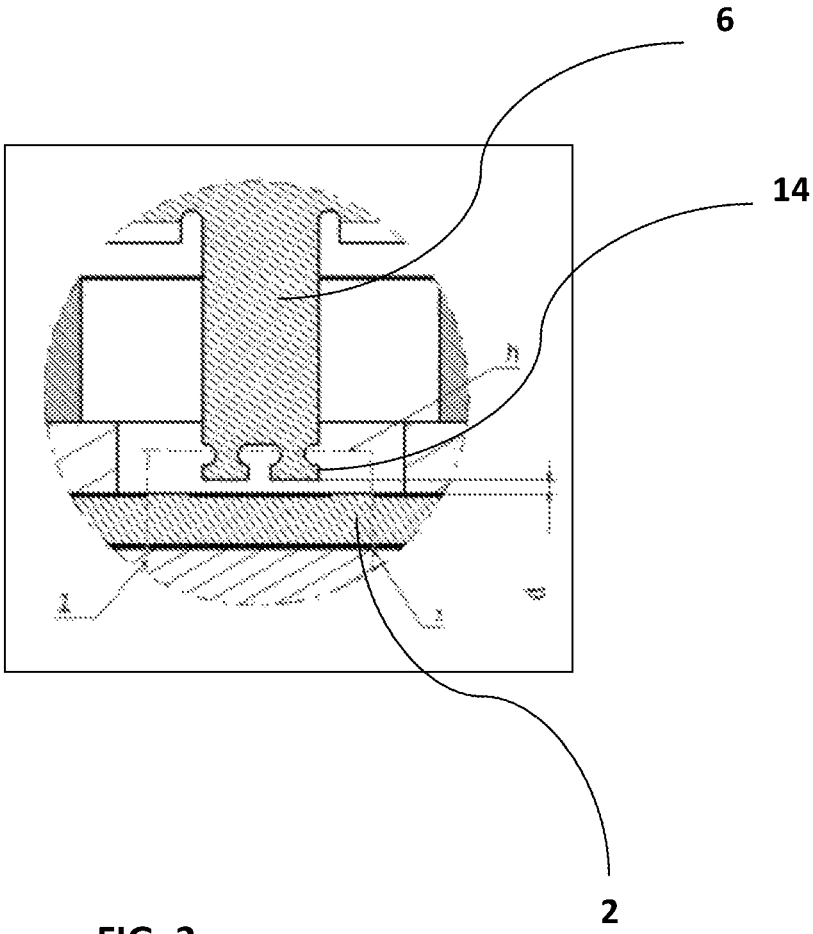
FIG. 3 represents one way of fixing the strip to the membrane.

The variant shown in FIG. 2 has the following features:

a) A micropump is fixed to a rigid part 11.

b) A fluid is aspirated or discharged as a function of the movement of the strip 6.

c) Electrical contacts 15 are disposed in the vicinity of the fixed point 8 of the piezo-electric element 5.

d) The flexible strip 6 is fixed to the end 9 of the piezo-electric element 5 and to the membrane 2. When an electrical voltage is applied to one of the contacts of the piezo-electric element 5, that voltage causes a contraction that is reflected in an angular movement, the greatest movement occurring at the free end 9 of the piezo-electric element 5.

e) The movement induced by the piezo-electric element 5 pulls or pushes the strip 6 along a vertical axis; non-vertical movements are absorbed by deformation of the strip 6.

f) An end 14 of the strip 6 is stuck to the membrane 2 (see FIG. 3), the other end 10 being stuck to the piezo-electric element 5.

g) The material of the strip 6 is preferably stainless steel 0.05 mm thick. It is cut and bent to shape.

h) To obtain good sticking between the strip 6 and the membrane 2, cavities (forming crenelations) are cut out from the end concerned of the strip (see FIG. 4 which represents the lower end of the strip 6 in a plane perpendicular to the planes of the other figures).

i) The piezo-electric element 5 is preferably a bimorph actuator plate having three electrical contacts.

j) The rigid part 11 is subjected to forces transmitted by deformation of the piezo-electric element 5. To ensure sufficient rigidity for correct operation of the pump, the rigid part 11 is preferably produced in ceramic.

k) The membrane 2 is delicate; the connection with the strip 6 is preferably produced by a drop of glue, and a safety distance between the parts prevents damaging the membrane 2. Variations in thickness of the rigid part or the length of the strip are compensated by more or less deep penetration into the drop of glue.

l) The strip 6 is sized and sufficiently rigid to push and pull the membrane 2, but also sufficiently deformable by buckling within the elastic limit if an overpressure caused by a blockage generates a greater force; this prevents damage to the pump.

It goes without saying that the invention is not limited to the above examples.

The invention claimed is:

1. A micropump comprising:

a flexible membrane, a pumping chamber, the flexible membrane operatively connected to the pumping chamber, and an actuator disposed externally of the pumping chamber and the flexible membrane, the actuator being arranged as a cantilever for moving the flexible membrane via a strip that has a main axis, the cantilever is connected to the strip at a moving part, and to a rigid body at a fixed part, wherein the pumping chamber communicates with an exterior environment of the micropump, wherein the strip connects the cantilever with the flexible membrane for pushing and pulling the flexible membrane by a motion of the actuator, the strip is disposed along the main axis and inside an opening of the rigid body, the strip is rigid along the main axis and is flexible in a lateral direction perpendicular to the main axis, a stiffness of the strip enables of a force of the actuator into a linear movement of the membrane, and the strip is laterally flexible to move in the lateral direction to absorb lateral forces produced by the actuator and to allow buckling within the elastic limit of the strip upon an overpressure, and wherein the actuator is configured to bend with a force generated internal to the actuator.

2. The micropump as claimed in claim 1 wherein the actuator is a piezo-electric bimorph actuator or multimorph actuator.

3. The micropump as claimed in claim 1 wherein the actuator is a thermal bimorph actuator.

4. The micropump as claimed in claim 1 wherein the actuator is a shape memory alloy.

5. The micropump as claimed in claim 1, wherein the actuator is fixed to a rigid support plate, the rigid support plate having a passage through which the strip passes to connect to the flexible membrane.

6. The micropump as claimed in claim 5 wherein the actuator has a fixed end fixed to said rigid support plate.

7. The micropump as claimed in claim 6 wherein the strip does not come into direct contact with the membrane.

8. The micropump as claimed in claim 1, wherein the actuator has a fixed end and a free end, the free end being disposed at a certain distance along the main axis from the membrane, one end of the strip being fixed to the free end.

9. The micropump as claimed in claim 8 wherein the strip is stuck to the actuator.

10. The micropump as claimed in claim 8 wherein the strip is in direct contact with the membrane.

11. The micropump as claimed in claim 8 wherein the strip is stuck to the membrane.

12. The micropump as claimed in claim 11 wherein the end of the strip fixed to the membrane has a crenelated contour to reinforce the sticking.

13. The micropump as claimed in claim 11 wherein the strip does not come into direct contact with the membrane, and is attached to the membrane by glue.

14. The micropump as claimed in claim 13 wherein the space between the strip and the membrane is filled with glue.

15. The micropump as claimed in claim 8 wherein the actuator includes electrical contacts disposed in the vicinity of said fixed end.

16. The micropump as claimed in claim 15 wherein the actuator is a multimorph actuator plate.

17. The micropump as claimed in claim 8, wherein the actuator is attached to a rigid plate by the fixed end, and the rigid plate has an opening in the direction of the main axis of the strip, such that the strip leads through the opening from the free end of the actuator to the flexible membrane.

18. The micropump as claimed in claim 17, wherein the rigid plate is made of ceramic.

19. The micropump as claimed in claim 1 wherein the strip is in stainless steel.

20. The micropump as claimed in claim 1 wherein the pumping chamber communicates with the exterior environment via the flexible membrane.

21. The micropump as claimed in claim 1 wherein the strip is less than 0.05 mm thick.

22. A micropump comprising:

a flexible membrane, a pumping chamber, the flexible membrane operatively connected to the pumping chamber, an actuator arranged as a cantilever disposed externally of the pumping chamber and the flexible membrane, and a strip connecting the actuator with the flexible membrane for pushing and pulling the flexible membrane by a motion of the actuator, the cantilever is connected to the strip at a moving part, and to a rigid body at a fixed part, wherein the strip that is rigid along its main axis and flexible in a lateral direction perpendicular to its main axis, the strip is disposed along the main axis and inside an opening of the rigid body, a stiffness of the strip enabling transmission of a force of the actuator into a linear movement of the membrane, and the strip is laterally flexible to move in the lateral direction to absorb lateral forces produced by the actuator and to allow buckling within the elastic limit of the strip upon an overpressure, wherein an end of the strip is fastened to the membrane by a drop of glue, and wherein the end of the strip is spaced apart from the membrane.

23. The micropump as claimed in claim 22 wherein the strip is less than 0.05 mm thick.

24. The micropump as claimed in claim 22 wherein the actuator is configured to bend with a force generated internal to the actuator.

* * * * *